US008251534B2

(12) United States Patent
Berman

(10) Patent No.: US 8,251,534 B2
(45) Date of Patent: Aug. 28, 2012

(54) KEY HOLDER

(76) Inventor: Lee Berman, Bournemouth (GB)

( * ) Notice: Subject to any disclaimer, the term of this patent is extended or adjusted under 35 U.S.C. 154(b) by 502 days.

(21) Appl. No.: 12/474,458

(22) Filed: May 29, 2009

(65) Prior Publication Data

US 2009/0296377 A1 Dec. 3, 2009

(30) Foreign Application Priority Data

May 29, 2008 (GB) ..... 0809798.2

(51) Int. Cl.

| | |
|---|---|
| ***F21V 33/00*** | (2006.01) |
| ***A44B 6/00*** | (2006.01) |
| ***A44B 15/00*** | (2006.01) |
| ***A44B 19/00*** | (2006.01) |
| ***A45F 5/00*** | (2006.01) |
| ***A45C 11/32*** | (2006.01) |
| ***A47G 29/10*** | (2006.01) |

(52) U.S. Cl. ..... 362/116; 24/3.6; 24/576.1; 24/580.11; 70/456 R

(58) Field of Classification Search ..... 362/116; 24/576.1, 578.12, 580, 3.6; 70/456 R, 456 B, 70/457–460

See application file for complete search history.

(56) References Cited

U.S. PATENT DOCUMENTS

| | | | | |
|---|---|---|---|---|
| 3,442,171 | A | 5/1969 | Engelmann | |
| 3,780,901 | A | 12/1973 | Pechacek | |
| 4,085,315 | A | 4/1978 | Wolter et al. | |
| 4,303,966 | A * | 12/1981 | Wolter | 362/116 |
| 4,392,186 | A | 7/1983 | Cziment | |
| 4,725,827 | A * | 2/1988 | Gallegos et al. | 341/20 |
| 5,008,784 | A * | 4/1991 | Wang | 362/116 |
| 5,318,177 | A * | 6/1994 | Isacson | 206/38.1 |
| 5,730,013 | A | 3/1998 | Huang | |
| 6,132,058 | A | 10/2000 | Kuo | |
| 6,164,795 | A | 12/2000 | Lopez | |
| 6,182,484 | B1 * | 2/2001 | Wolter | 70/395 |
| 6,405,572 | B1 * | 6/2002 | Seamans | 70/456 R |
| 6,601,967 | B1 * | 8/2003 | Zeller | 362/116 |
| 6,609,811 | B1 * | 8/2003 | Sharrah | 362/116 |
| 7,036,950 | B1 * | 5/2006 | Freeman et al. | 362/100 |
| 2007/0159811 | A1 * | 7/2007 | Chen | 362/116 |

FOREIGN PATENT DOCUMENTS

| | | |
|---|---|---|
| AT | 383 563 | 7/1987 |
| CH | 193060 | 12/1937 |
| DE | 10 2004 027 182 | 12/2005 |
| FR | 1 425 414 | 12/1965 |
| GB | 2 024 394 | 1/1980 |
| GB | 2 431 430 | 4/2007 |
| JP | 62-15895 | 1/1987 |

OTHER PUBLICATIONS

Extended European Search Report Issued on Application No. 09251424.9 on Sep. 16, 2009.

* cited by examiner

*Primary Examiner* — Jong-Suk (James) Lee
*Assistant Examiner* — David J Makiya
(74) *Attorney, Agent, or Firm* — Ladas & Parry LLP

(57) ABSTRACT

A key holder including an illumination means for illuminating a key shank, the key holder including first and second cooperating parts for accommodating the handle of the key therebetween, said first cooperating part including a fastening means releasably engageable with a key ring mount permanently fixed on said second cooperating part, said fastening means and key ring mount arranged in use to secure the cooperating parts to each other.

23 Claims, 7 Drawing Sheets

KEY HOLDER

The present invention relates to a key holder including an illumination means. The invention also relates to the combination of such a key holder with a key or a key blank.

Such key holders are known from GB 2,431,430 and are useful for locating the keyhole when the key is used in the dark. One disadvantage of the key holder of GB 2,431,430 is that it has a relatively complex construction. Another disadvantage is that because the key holder utilises a separate key ring mount portion and a separate clip portion, there is a risk of losing the key ring mount or clip portion. Subsequently the key holder cannot be used anymore.

A desire of the present invention is to provide a key holder to alleviate or overcome at least one of the above disadvantages. Furthermore the key holder of the claimed invention can be easily fitted to and released from a key handle.

Accordingly the invention provides a key holder including an illumination means for illuminating a key shank, the key holder including first and second cooperating parts for accommodating the handle of the key therebetween, said first cooperating part including a fastening means releasably engageable with a key ring mount permanently fixed on said second cooperating part, said fastening means and key ring mount arranged in use to secure the cooperating parts to each other.

Preferably the fastening means is operable to couple with the key ring mount to secure the cooperating parts to each other. More preferably the fastening means is operable to clip onto the key ring mount to secure the cooperating parts to each other. Yet more preferably said fastening means comprises an integral clip on said first cooperating part. Even more preferably the integral clip is for clipping onto a barrel portion of the key ring mount to secure the cooperating parts to each other. Preferably said clipping is snap clipping. More preferably said clip further comprises a tool-engaging aperture for registering with a tool engaging aperture on said second cooperating part to enable said first cooperating part to be unclipped from said second cooperating part with a tool. Yet more preferably the first and second cooperating parts comprise respective first and second shell portions each having a sidewall, wherein the fastening means is formed as a cut out from the sidewall of the first shell portion and wherein the permanently fixed key ring mount is formed on the sidewall of the second shell portion. Even more preferably said barrel portion of said permanently fixed key ring mount is formed intermediate a barrel head portion and a boss portion. Preferably the respective sidewall portions of said first shell portion and said second shell portion are arranged in use to engage with each other to partially enclose the illumination means and the key handle. More preferably the permanently fixed key ring mount is mounted on said sidewall of said second shell portion for free rotation about its longitudinal axis both when the respective cooperation parts are separated and when the first cooperating part is clipped to the second. Yet more preferably the respective sidewalls overlap on engagement. Even more preferably the illumination means comprises a cartridge including a power supply and a light source, the cartridge being arranged in use to be retained against one face of the key. Preferably said cartridge comprises a battery compartment and has a switch which is accessible via an aperture in one of said cooperating portions. More preferably said second shell portion has a base which is shaped and dimensioned to receive a key handle, and an opening is formed in said sidewall thereof for accommodating the key shank and said second shell portion is capable of retaining said cartridge against said key handle. Yet more preferably said cartridge is composed of flexible plastics material and said switch is integrally formed in a wall of said battery compartment. Even more preferably a holding means is formed between the two cooperating parts for holding the key handle securely in position to prevent it from moving between the two cooperating parts in use. Preferably the cartridge further comprises a removable member for enclosing the batteries in the battery compartment so that the battery compartment is substantially watertight. More preferably the holding means is formed on a surface of the removable member. Yet more preferably the holding means comprises a protrusion forming a portion shaped to fit the key handle for holding the key handle securely in position to prevent it from moving between the two cooperating parts in use. Even more preferably the said cartridge is arranged to be retained against one face of the key and the other face of the key abuts a base of the second shell portion. Preferably in use said key handle is positioned within said cartridge. More preferably said boss portion has an aperture therein for receiving a key ring. Yet more preferably said illumination means as an LED. Even more preferably in use the key is secured within the key holder for preventing movement of the key between the two cooperating parts for unlocking a lock.

As described herein the key ring mount is permanently fixed on said second cooperating part. This means that in use the key ring mount can not be separated from the second cooperating part.

A preferred embodiment of the invention is described below by way of example only with reference to FIGS. 1 to 7 of the accompanying drawings, wherein.

Figure 1:
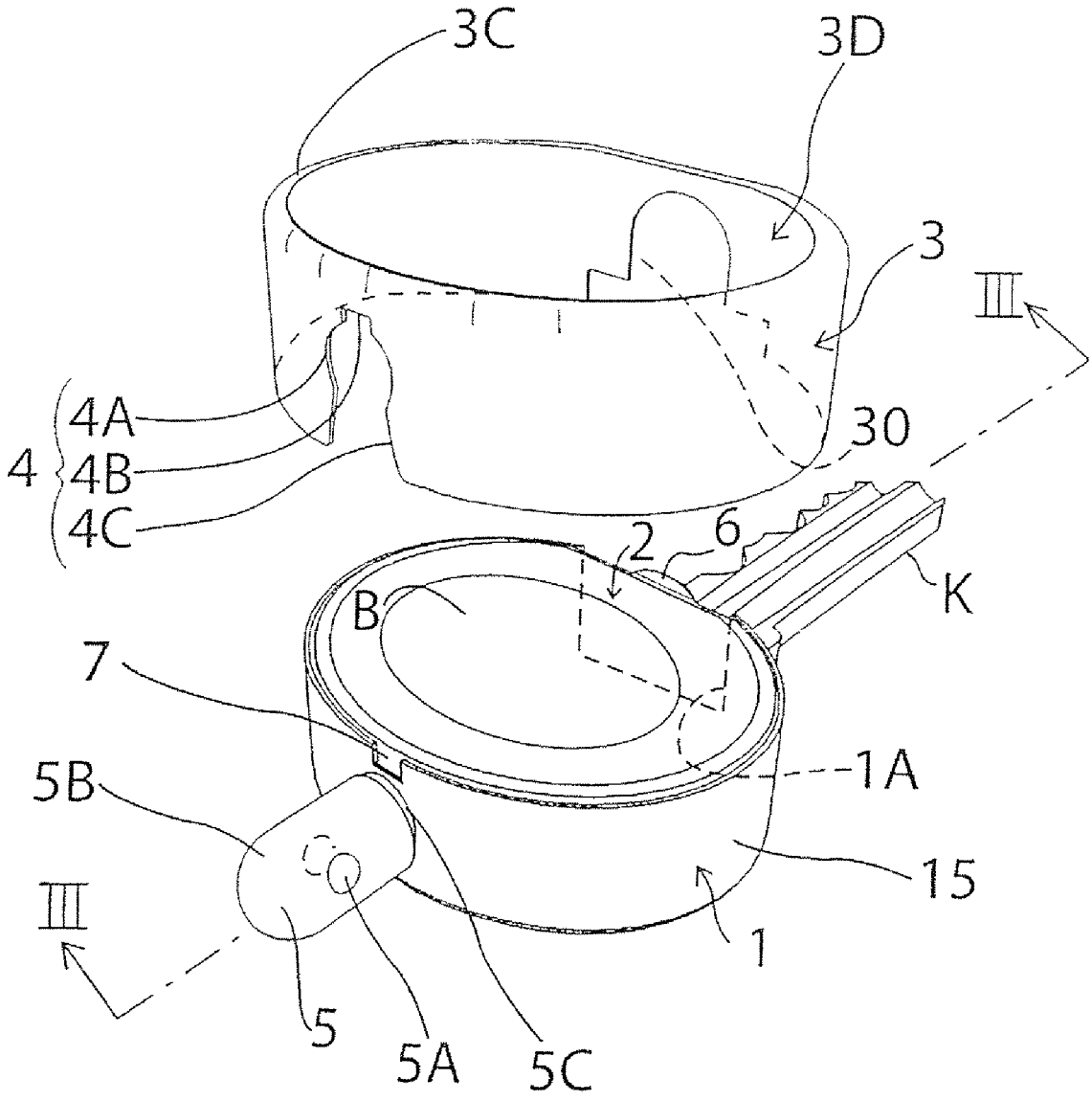
FIG. 1 is an exploded perspective view of a key holder and key combination in accordance with the invention.

Referring to FIG. 1, the key holder comprises a lower shell portion 1 pressed from stainless steel sheet and having a generally oval shaped sidewall 15 and a flat base on which a key K rests. The shank of the key extends longitudinally through a cut out portion 1A extending from the upper edge of the sidewall to the base. The base and sidewall of the lower shell of the key holder are shaped to accommodate universally shaped key handles. Any of the various differently shaped key handles available in the market can be accommodated. These can be made to fit through the use of a holding means described in more detail below. For example key handles made by Yale (3 differently shaped handles), Chubb, Union and key handles made by other generic manufacturers can be made to fit using the holding means. A key ring mount portion 5 is permanently fixed on the sidewall opposite this cut out portion. A further cut out portion 7 is formed in sidewall 15 of lower shell portion 1 extending from the upper edge of the sidewall to above the key ring mount portion. A cartridge 2 carrying a forwardly projecting LED 6 (which is longitudinally aligned with the shaft of key K) is received within shell portion 1 and carries an integral push button B on its top surface.

Figure 2:
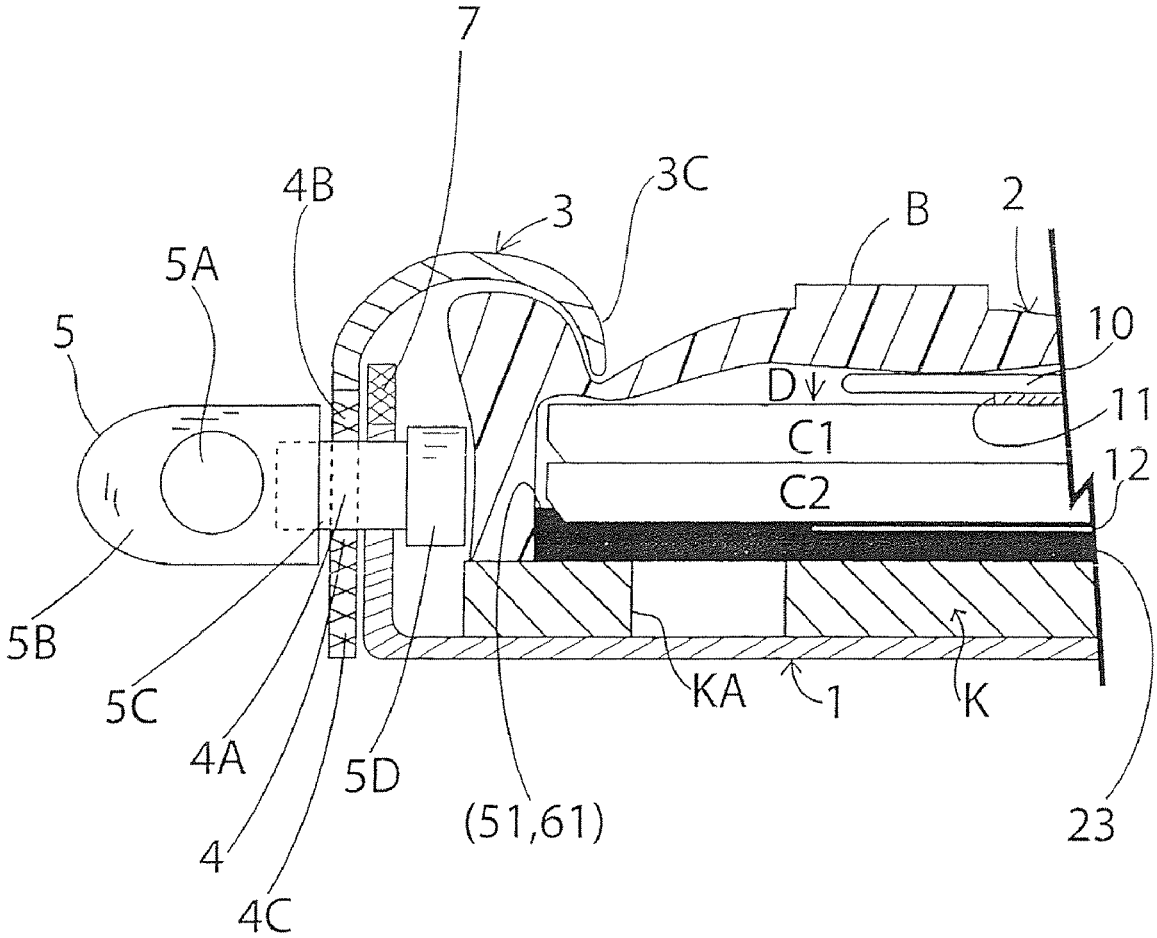
FIG. 2 is a partial cross section taken on III-III of FIG. 1.

An upper generally cylindrical shell portion 3, also pressed from stainless steel sheet, is shaped to fit over lower shell portion 1 and has a large generally circular aperture 3D in its top wall for accommodating button B, as also shown in FIG. 2. A cut out portion 30 extending from the lower edge of the sidewall to near the top wall is formed to accommodate the LED 6 and the shank of key K. Opposite this cut out portion, an integral clip portion 4 again extending from the lower edge of the sidewall to near its top is formed as a cut out from the sidewall portion for clipping the upper shell portion 3 to key ring mount portion 5. The integral clip portion 4 comprises two arm portions 4A, a cut out head portion 4B formed immediately above the arm portions 4A, and cut out leg portions 4C formed immediately below the arm portions. The cut out leg portions define an opening which provides access for the key ring mount portion 5 so that the arm portions 4A of the integral clip portion 4 can be resiliently engaged with a barrel portion 5C of the key ring mount portion 5. This will be illustrated below.

Referring to FIGS. 1 to 7, the key ring mount portion 5 having a diametral aperture 5A in an external boss portion 5B thereof includes a barrel portion 5C adapted to engage with the arm portions 4A of the integral clip portion 4.

Referring to FIG. 2 and in conjunction with FIG. 1, the barrel portion 5C is passed through the opening defined by the cut out leg portions 4C, and is clipped by the arm portions 4A of the integral clip portion 4 to secure the lower shell portion 1 to the upper shell portion 3. The clipping is formed by resilient engagement of the arm portions 4A with barrel portion 5C. This resilience enables the upper shell portion 3 to be forced downwardly or upwardly to force apart the arm portions 4A to engage or disassemble the upper shell portion 3 with the key ring mount portion 5. The shell portion 3 is suitably stamped from spring steel to provide the necessary strength and resilience. Preferably the head portion 4B is also a tool engaging aperture portion which registers with tool engaging cut out portion 7 of lower shell portion 1. Head portion 4B and cut out portion 7 together provide access for a small screwdriver blade or a similar tool which can be used to unclip the assembly by inserting the tool blade into cut out portion 7 through the head portion 4B and levering the tool blade upwardly against head portion 4B.

Figure 7:
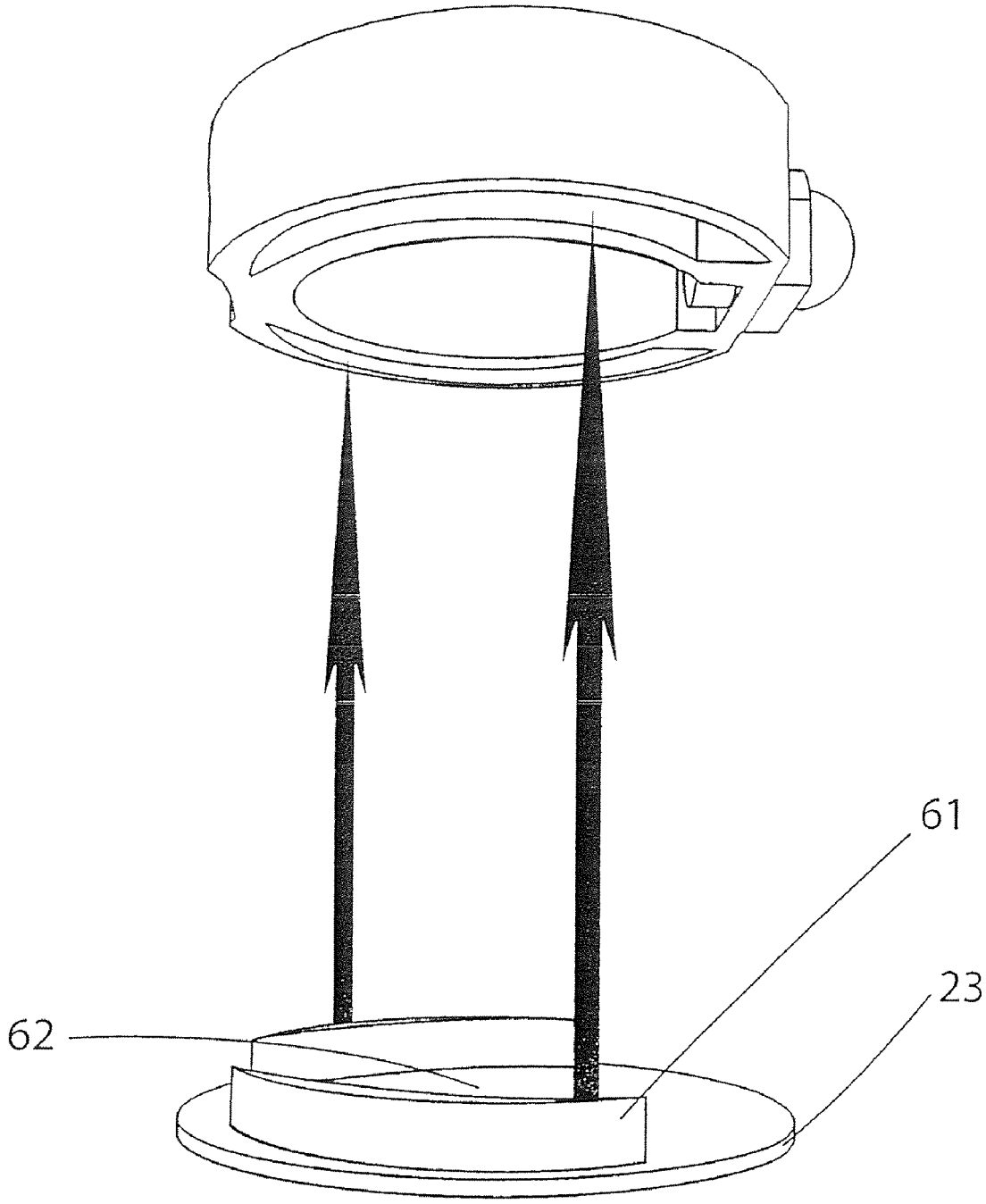
FIG. 7 shows an exploded view of a cartridge of the key holder of the invention.

Referring to FIG. 2, the cartridge 2 which suitably comprises an integral moulding of flexible plastics material is shown held against the upper face of the key K by the downwardly turned inner portion 3C of the upper shell portion 3 that defines the periphery of upper shell 3. The cartridge defines a battery compartment in which two button cells C1 and C2 are stacked, a lower terminal of cell C2 contacting a wire 12 which extends to the LED (not shown in FIG. 2) and the opposite terminal of cell C1 lying immediately beneath a further wire 10 which is spaced apart therefrom by a thin insulating layer 11. Removable hatch 23 lying below wire 12 allows access to the battery compartment to replace used batteries. In less preferred embodiments (not shown) removable hatch 23 is absent and cartridge 2 is open so that wire 12 abuts upper face of key K. Removable hatch 23 as also shown in FIGS. 5-7 comprises at least one protrusion (51, 61) on one surface. For large key handles such as Yale key handles as shown in FIG. 2 which have the general shape of the flat base of the lower shell portion 1, the at least one protrusion is not needed for holding the key. Hatch 23 is positioned so that its flat side engages and is retained against the key handle. The at least one protrusion (51, 61) on its opposite side is accommodated by the battery compartment as shown in FIG. 7. The key handle is held sufficiently tightly by sidewall 15 and flat base of lower shell portion 1.

Figure 5A:
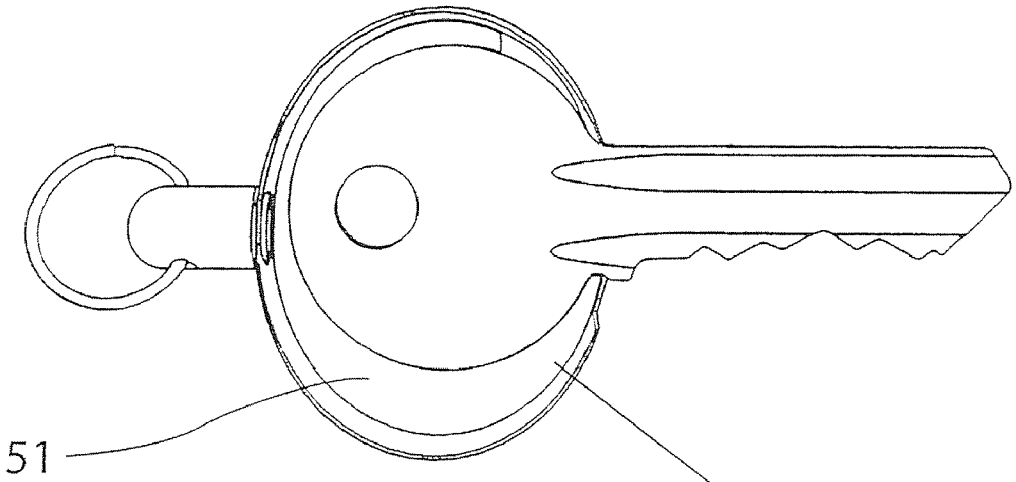
FIG. 5A shows a perspective view of a key fitted within a removable hatch of a cartridge of the key holder of the invention.
Figure 5B:
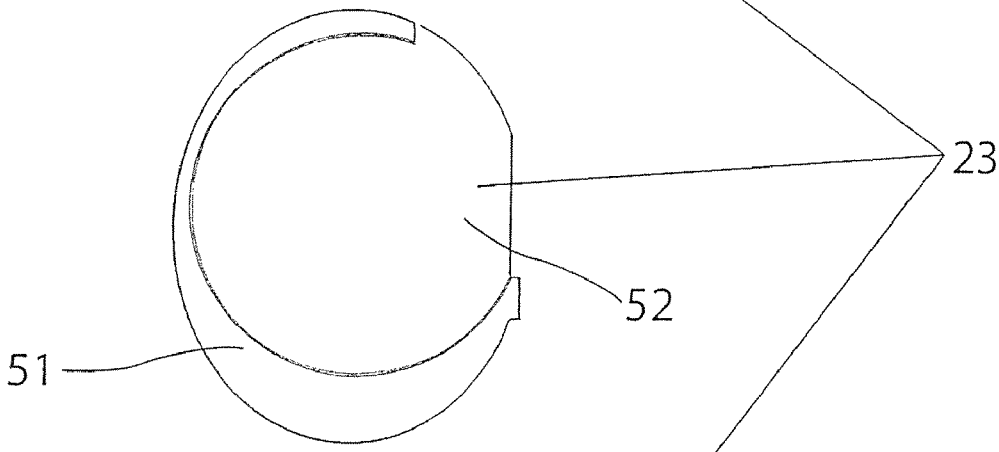
FIG. 5B shows one side of the removable hatch of the cartridge of FIG. 5A.
Figure 5C:
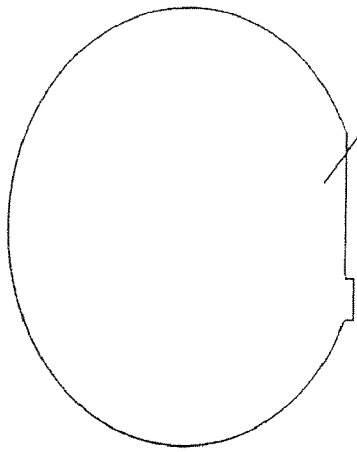
FIG. 5C shows the other side or the removable hatch of the cartridge of FIG. 5B.
Figures 6A, 6B, 6C:
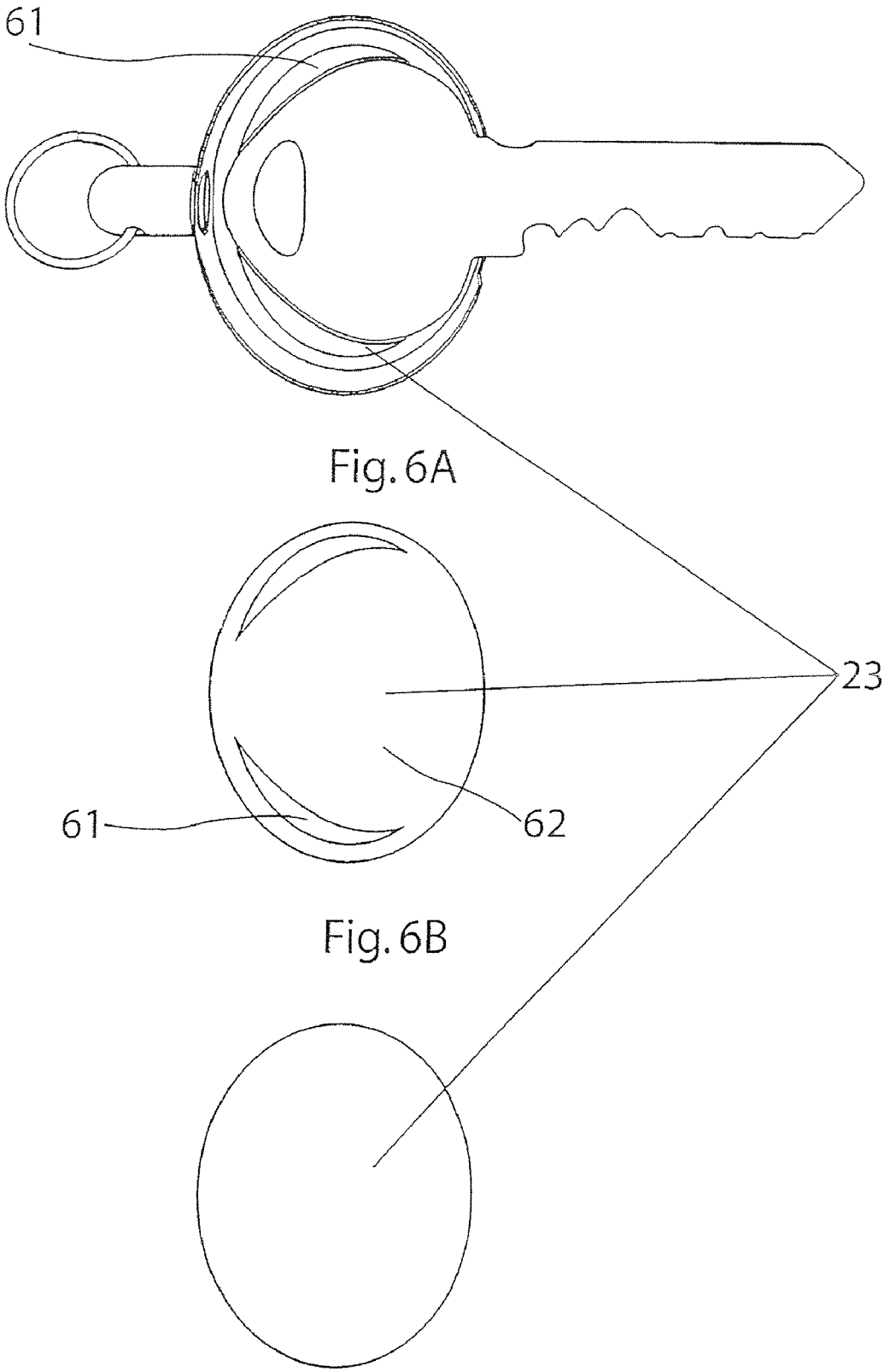
FIG. 6A shows a perspective view of a different key fitted within a different removable hatch of a cartridge of the key holder of the invention.
FIG. 6B shows one side of the removable hatch of the cartridge of FIG. 6A.
FIG. 6C shows the other side of the removable hatch of the cartridge of FIG. 6B.

As seen in FIGS. 5A-5B and 6A-6B space (52, 62) formed by the at least one protrusion (51, 61) is shaped to fit one of the plurality of differently shaped smaller key handles available in the market. The other side of hatch 23 is flat as shown in FIGS. 5C and 6C. For the smaller key handles shown in FIGS. 5A and 6A the space (52, 62) is used to hold the key handle tightly within the key holder to prevent movement of the key within the key holder in use. These smaller key handles can be positioned between hatch 23 and cartridge 2 so that the flat side of hatch 2 abuts the base of lower shell portion 1 the at one protrusion (51, 61) engages cartridge 2 and key handle is held within space (52, 62) as partly shown in FIGS. 5A and 6A. Alternatively (not shown) hatch 23 can be positioned between the key handle and the cartridge 2 so that one side of the key handle engages the base or lower shell portion 1 and the other side of the key handle engages hatch 23 and the key handle is held within space (52, 62). The at least one protrusion (51, 61) then abuts the base of the lower shell portion and the flat side of hatch 23 engages cartridge 2. A terminal portion of the wire 10 extends between the inner surface of button B and the exposed upper terminal portion of cell C1 and can be forced into contact therewith as indicated by arrow D when the button B is depressed by the user. In this manner the LED 6 is switched on until the button B is released.

Figure 3:
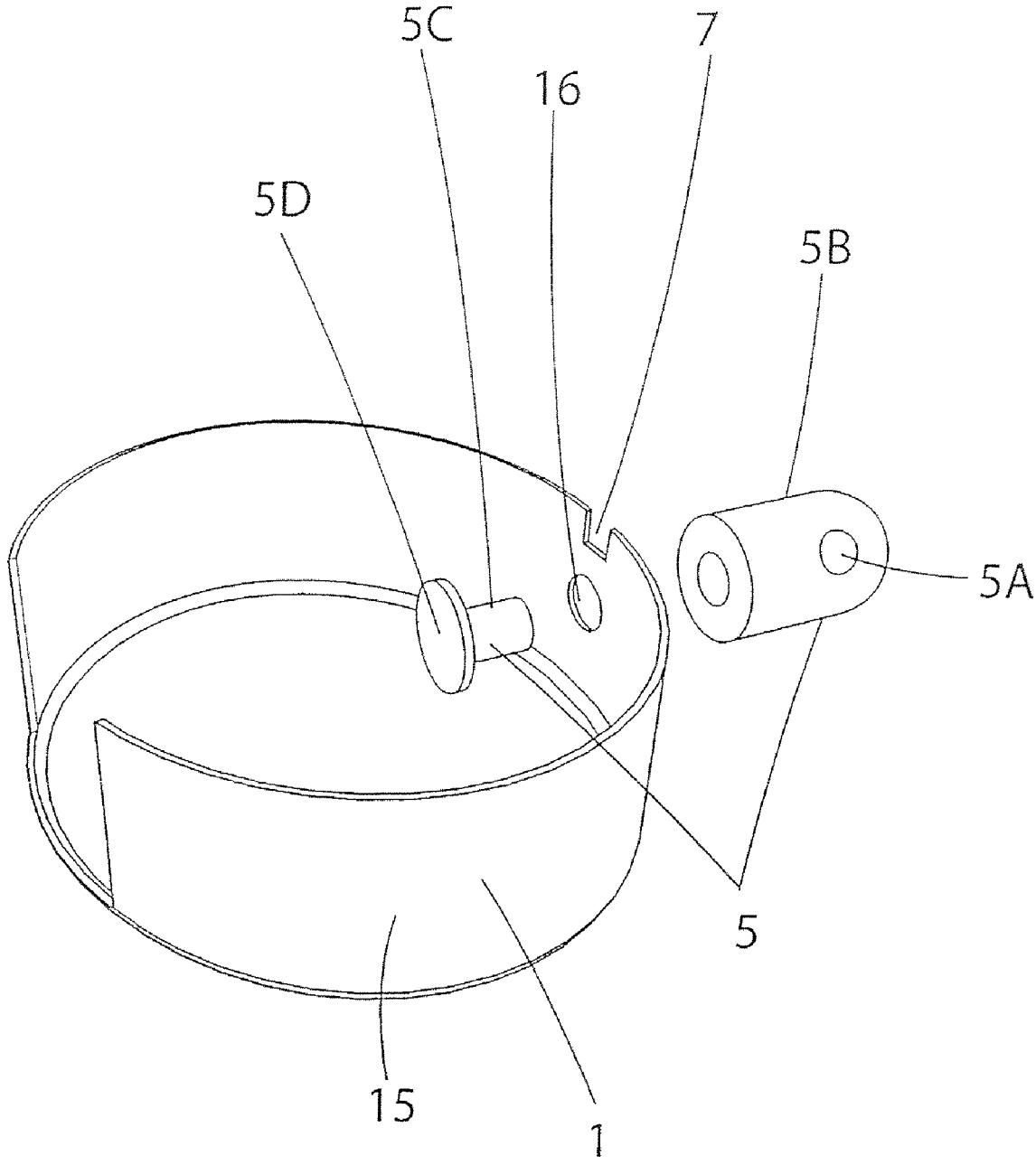
FIG. 3 is an exploded perspective view showing a key ring mount in accordance with the invention.

Preferably, as shown in FIG. 3, the boss portion 5B has diametral aperture 5A for mounting lower shell portion on a key ring. The key ring mount portion 5 is permanently fixed on the sidewall 15 of lower shell portion 1. A preferred method of manufacture of the key ring mount portion of the key holder of the present invention includes passing barrel portion 5C through an aperture 16 in the sidewall 15 and plugging barrel portion 5C into boss portion 5B of key ring mount 5 permanently to fix key ring mount 5 to lower shell portion 1 by press fixing. Alternatively (not shown in FIG. 3) the barrel portion can include a screw thread for permanently fixing barrel portion to boss portion by a screw fit. Even if such a screw fitted boss portion could be disassembled by unscrewing the barrel portion from the boss portion, nevertheless the fixing is permanent as defined herein because the respective portions are permanently fixed to each other in use. The term in use as used herein includes normal use when the cooperating parts are disassembled to replace the batteries for example. Key ring mount 5 is permanently fixed on the sidewall 15 so that the longitudinal axis of the boss portion 5B is parallel to is the diameter of the generally oval shaped base portion. The key ring mount 5 can freely rotate about its longitudinal axis. Boss portion 5B can spin freely about its longitudinal axis both when the key holder is disassembled and when the key holder is assembled (lower shell portion 1 clipped to upper shell portion 3). This freedom for boss portion to spin allows the key holder to rotate about the longitudinal axis of the boss portion when mounted on a key ring to use the key shank and light source more easily even when the key ring holds many other keys etc., which might otherwise interfere with free movement of the key holder.

Figure 4:
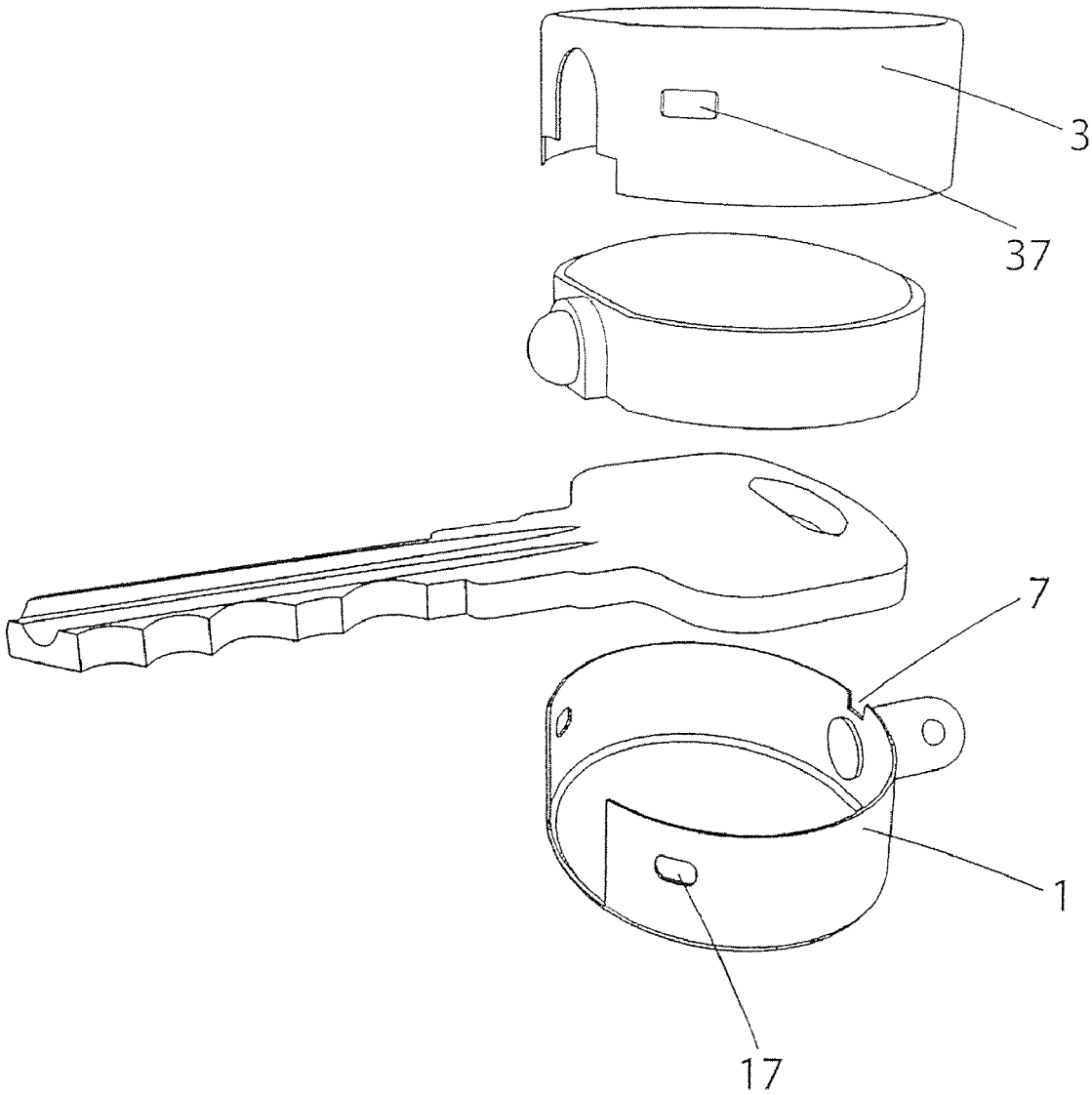
FIG. 4 is an exploded perspective view of a second embodiment of a key holder in accordance with the invention.

Referring to FIG. 4, in order to facilitate the engagement between the upper shell portion 3 and the lower portion 1, a dimple portion 37 projected inwardly is formed on the sidewall of the upper shell portion 3, and a recess 17 is formed on the sidewall of the lower shell portion 1. When the upper shell portion 3 is pressed downwardly towards the lower shell portion 1 to assemble the key holder, the dimple portion 37 of the upper shell portion 3 becomes engaged with the recess 37 of the lower shell portion. Thereby secure engagement between the two shell portion. Thereby secure engagement between the two shell portions is further enhanced.

It will be noted that the conventional key ring aperture KA of the key K is covered by the lower shell portion 1 but the diametral aperture 5A in key ring mount 5 provides an alternative mounting for a key ring (not shown).

In a less preferred embodiment the LED 6 could be replaced by an incandescent bulb.

In a variant the cartridge 2 could be formed integrally with the upper shell portion 3.

The invention claimed is:

1. A key holder including an illumination means for illuminating a key shank, the key holder including first and second cooperating parts for accommodating a handle of the key therebetween, said first cooperating part including a fastening means releasably engageable with a key ring mount permanently fixed on said second cooperating part, said fastening means and key ring mount arranged in use to secure the cooperating parts to each other, the first and second cooperating parts comprising respective first and second shell portions each having a sidewall, wherein the fastening means is formed as a cut out from the sidewall of the first shell portion and wherein the permanently fixed key ring mount is formed on the sidewall of the second shell portion, said fastening means comprises an integral clip on said first cooperating part which is for clipping onto a barrel portion of the key ring mount to secure the cooperating parts to each other.

2. The key holder according to claim 1, wherein the fastening means is operable to couple with the key ring mount to secure the cooperating parts to each other.

3. The key holder according to claim 1, wherein the fastening means is operable to clip onto the key ring mount to secure the cooperating parts to each.

4. The key holder according to claim 1, wherein said clipping is snap clipping.

5. The key holder according to claim 1, wherein said clip further comprises a tool engaging aperture for registering with a tool engaging aperture on said second cooperating part to enable said first cooperating part to be unclipped from said second cooperating part with a tool.

6. The key holder according to claim 1, wherein said barrel portion of said permanently fixed key ring mount is formed intermediate a barrel head portion and a boss portion.

7. The key holder according to claim 1, the respective sidewall portions of said first shell portion and said second shell portion arranged in use to engage with each other to partially enclose the illumination means and the key handle.

8. The key holder according to claim 1, wherein the permanently fixed key ring mount is mounted on said sidewall of said second shell portion for free rotation about its longitudinal axis both when the respective cooperation parts are separated and when the first cooperating part is clipped to the second.

9. The key holder according to claim 1, wherein the respective sidewalls overlap on engagement.

10. The key holder according to claim 1, wherein the illumination means comprises a cartridge including a power supply and a light source, the cartridge being arranged in use to be retained against one face of the key.

11. The key holder according to claim 10, wherein said cartridge comprises a battery compartment and has a switch which is accessible via an aperture in one of said cooperating portions.

12. The key holder according to claim 10, said second shell portion having a base which is shaped and dimensioned to receive a key handle, an opening being formed in said sidewall thereof for accommodating the key shank and said second shell portion capable of retaining said cartridge against said key handle.

13. The key holder according to claim 10, wherein said cartridge is composed of flexible plastics material and said switch is integrally formed in a wall of said battery compartment.

14. The key holder according to claim 1, wherein a holding mean is formed between the two cooperating parts for holding the key handle securely in position to prevent it from moving between the two cooperating parts in use.

15. The key holder according to claim 14, wherein the cartridge further comprises a removable member for enclosing the batteries in the battery compartment so that the battery compartment is substantially watertight.

16. The key according to claim 15, wherein the holding means is formed on a surface of the removable member.

17. The key holder according to claim 16, wherein the holding means comprises a protrusion forming a portion shaped to fit the key handle for holding the key handle securely in position to prevent it from moving between the two cooperating parts in use.

18. The key holder according to claim 17, wherein the said cartridge is arranged to be retained against one face of the key and wherein the other face of the key abuts a base of the second shell portion.

19. The key holder according to claim 17, wherein in use said key handle is positioned within said cartridge.

20. The key holder according to claim 6, wherein said boss portion has an aperture therein for receiving a key ring.

21. The key holder according to claim 1, wherein said illumination means is an LED.

22. A key holder according to claim 1, wherein in use the key is secured within the key holder for preventing movement of the key between the two cooperating parts for unlocking a lock.

23. The key holder as claimed in claim 1, in combination with a key or key blank.

* * * * *